US005284597A

United States Patent [19]

Rees

[11] Patent Number: 5,284,597

[45] Date of Patent: Feb. 8, 1994

[54] AQUEOUS ALKALINE SOFT-SURFACE CLEANING COMPOSITIONS COMPRISING TERTIARY ALKYL HYDROPEROXIDES

[75] Inventor: Wayne M. Rees, Cincinnati, Ohio

[73] Assignee: S. C. Johnson & Son, Inc., Racine, Wis.

[21] Appl. No.: 995,857

[22] Filed: Dec. 23, 1992

[51] Int. Cl.[5] ..... C11D 3/39; C11D 3/395; C11D 17/08; D06L 3/02

[52] U.S. Cl. ..... 252/103; 8/111; 8/137; 252/95; 252/104; 252/158; 252/170; 252/171; 252/173; 252/550; 252/DIG. 1; 252/DIG. 14

[58] Field of Search ..... 252/95, 103, 104, 550, 252/173, DIG. 1, 158, 170, 171, DIG. 14; 8/111, 137

[56] References Cited

U.S. PATENT DOCUMENTS

| | | | |
|---|---|---|---|
| 3,574,519 | 4/1971 | Lincoln | 8/111 |
| 3,709,778 | 1/1973 | Lincoln | 8/111 |
| 3,746,646 | 7/1973 | Boixader | 252/95 |
| 3,753,915 | 8/1973 | Demangeon | 252/95 |
| 3,979,317 | 9/1976 | Angelini | 252/170 |
| 4,054,534 | 10/1977 | Angelini | 252/158 |
| 4,379,068 | 4/1983 | Coudere | 252/99 |
| 4,689,168 | 8/1987 | Requejo | 252/139 |

*Primary Examiner*—Dennis Albrecht

[57] ABSTRACT

Aqueous soft surface cleaning compositions comprising from about 0.1% to about 5.0% by wt. of a tertiary alkyl hydroperoxide; and from about 99.9% to about 95% by wt. of an aqueous alkaline cleaning composition comprising acetylenic alcohol and an anionic surfactant, which are stable, color-safe and produce satisfactory cleaning results, especially in removing red wine, grape juice, blueberry and blood stains from carpeting.

2 Claims, No Drawings

AQUEOUS ALKALINE SOFT-SURFACE CLEANING COMPOSITIONS COMPRISING TERTIARY ALKYL HYDROPEROXIDES

BACKGROUND OF THE INVENTION

Oxidizing agents are frequently used in alkaline soft surface cleaning compositions. For certain applications, such as carpets and textiles, the oxidizing agents used must not alter the color of the surface they are used to clean. Peroxygen reagents, such as hydrogen peroxide, and hydrogen peroxide precursors, are known color-safe oxidizing agents when used at moderately low concentrations.

Alkaline soft surface cleaning compositions containing hydrogen peroxide or hydrogen peroxide releasing reagents typically come in powdered form, since these reagents rapidly autodecompose in alkaline aqueous solution. Although aqueous hydrogen peroxide cleaning compositions with an acidic pH are more stable than their alkaline counterparts, they are generally inferior cleaners for many types of soiled textiles.

U.S. Pat. No. 3,747,646 discloses a "powdery solid" detergent washing composition containing a water-soluble synthetic organic surface active agent and an alkali salt of a hydroperoxide.

U.S. Pat. No. 3,753,915 discloses a "powdery solid" biological cleaning preparation containing a proteolytic enzyme and a salt of an organic hydroperoxide.

U.S. Pat. No. 4,379,068 discloses a powdered detergent composition comprising an alkali metal mono- or polyalkylsulfonate hydroperoxide, a surfactant, sodium silicate, and a hydrophilic cotelomer.

U.S. Pat. No. 3,574,519 discloses a method for bleaching textiles by pre-treating the fabric with a buffer or alkaline solution, and contacting it with tertiary butyl hydroperoxides and water in the vapor phase.

Therefore, there exists a need for an aqueous alkaline peroxygen soft-surface cleaning composition that produces satisfactory cleaning results.

SUMMARY OF THE INVENTION

It is an object of this invention to provide an aqueous alkaline soft surface cleaning composition comprising a peroxygen reagent.

It is also an object of this invention to provide an aqueous alkaline soft surface cleaning composition, comprising a peroxygen reagent, that has long term stability.

It is also an object of this invention to provide an aqueous alkaline soft surface cleaning composition, comprising a peroxygen reagent, that is color-safe.

It is also an object of this invention to provide an aqueous alkaline soft surface cleaning composition, comprising a peroxygen reagent, that produces satisfactory cleaning results.

It has surprisingly been found that the peroxygen reagent, tertiary alkyl hydroperoxide, has long term stability in aqueous alkaline cleaning compositions and produces satisfactory, color-safe cleaning results. Accordingly, this invention provides aqueous alkaline soft surface cleaning compositions comprising tertiary alkyl hydroperoxide.

DETAILED DESCRIPTION OF THE INVENTION

The aqueous alkaline soft surface cleaning compositions of this invention comprise the class of peroxygen reagents known as tertiary alkyl hydroperoxides. Although any tertiary alkyl hydroperoxide may be used in accordance with this invention, T-Hydro (ARCO Chemical Company) and Luperox 2,5-2,5 (Atochem North America, Inc.) are preferred. The chemical name of Luperox 2,5-2,5 is 2,5-dimethylhexane-2,5-dihydroperoxide and the chemical name of T-Hydro is T-butyl hydroperoxide (TBHP). These tertiary alkyl hydroperoxides are present in the composition in concentrations of from about 0.1 % to about 5.0 %.

The base formula to which the tertiary alkyl hydroperoxide is added can be any aqueous alkaline soft surface cleaner, which when combined with tertiary alkyl hydroperoxide will result in a stable cleaning composition. A person skilled in the arts of cleaning chemical technology and oxidation reactivity would easily be able to determine if a particular aqueous alkaline cleaning composition would be suitable for combination with tertiary alkyl hydroperoxide. On this point, it is important to distinguish between the compatibility of the hydroperoxide with the cleaning composition and the ability of hydroperoxide to autodecompose via reaction with itself. The subject of this disclosure addresses the latter topic.

Aqueous alkaline cleaning compositions comprising these tertiary alkyl hydroperoxides are stable, color-safe and produce satisfactory cleaning results. These compositions produce particularly good cleaning results on red wine, grape juice, blueberry and blood stains.

The following examples are given to further illustrate the present invention. It should be understood, however, that the invention is not limited thereto.

EXAMPLE 1

Stability Comparison Between Alkaline Aqueous Cleaning Compositions Comprising Hydrogen Peroxide Or T-Butyl Hydroperoxide 15.0 g of 30% $H_2O_2$ were added per 1000 g of an alkaline aqueous cleaning composition ("Base Formula 1") (Composition 1A). This Composition has an initial concentration of 0.13M $H_2O_2$. Base Formula 1 is an aqueous cleaning composition that comprises the following raw materials per kg: 918.2 g deionized water, 25.0 g isopropanol, 15.0 g ethylene glycol n-hexyl ether (Union Carbide Corporation), 11.3 g sodium lauryl sulfate (Stepanol WA-40 (40% actives in water) Stepan Chemicals), 2.50 g Surfynol 61 (Air Products Corporation), 15.0 g trisodium citrate (1.00M in water), 2.5 g concentrated ammonia, 10.0 g DuPont Zeelan 338 (25% actives in water), and fragrance.

10.0 g of 70% t-butyl hydroperoxide (TBHP) were added per 1000 g of Base Formula 1 (Composition IB). This Composition has an initial concentration of 0.08M t-butyl hydroperoxide. Using concentrated ammonia, the pH of Compositions 1A and 1B was raised to the values indicated below.

The stability studies were conducted at room temperature (68° F.) and elevated temperature (125° F.) for up to 30 days. The peroxide content of the Compositions was measured using iodometric titration. The data from these studies are set forth below.

TABLE 1.1

| Room Temperature Stability At pH 8.0 | | | |
|---|---|---|---|
| Day | 0 | 9 | 28 |
| Composition 1A | | | |
| Amount $H_2O_2$ | 0.129 | 0.127 | 0.127 |

TABLE 1.1-continued

| Room Temperature Stability At pH 8.0 | | | |
|---|---|---|---|
| Day | 0 | 9 | 28 |
| % $H_2O_2$ Remaining | — | — | 98 |
| Composition 1B | | | |
| Amount TBHP | 0.080 | 0.081 | 0.081 |
| % TBHP Remaining | — | — | 100 |

TABLE 1.2

| Room Temperature Stability At pH 8.8 | | | |
|---|---|---|---|
| Day | 0 | 8 | 27 |
| Composition 1A | | | |
| Amount $H_2O_2$ | 0.128 | 0.122 | 0.116 |
| % $H_2O_2$ Remaining | — | — | 91 |
| Composition 1B | | | |
| Amount TBHP | 0.080 | 0.079 | 0.080 |
| % TBHP Remaining | — | — | 100 |

TABLE 1.3

| Room Temperature Stability At pH 9.5 | | | | | |
|---|---|---|---|---|---|
| Day | 0 | 5 | 12 | 19 | 29 |
| Composition 1A | | | | | |
| Amount $H_2O_2$ | 0.129 | 0.122 | 0.116 | 0.099 | 0.087 |
| % $H_2O_2$ Remaining | — | — | — | — | 67 |
| Composition 1B | | | | | |
| Amount TBHP | 0.078 | 0.081 | 0.080 | 0.080 | 0.079 |
| % TBHP Remaining | — | — | — | — | 100 |

TABLE 1.4

| Room Temperature Stability At pH 11.0 | | | | | |
|---|---|---|---|---|---|
| Day | 0 | 6 | 13 | 20 | 30 |
| Composition 1A | | | | | |
| Amount $H_2O_2$ | 0.129 | 0.102 | 0.074 | 0.078 | 0.036 |
| % $H_2O_2$ Remaining | — | — | — | — | 28 |
| Composition 1B | | | | | |
| Amount TBHP | 0.078 | 0.078 | 0.078 | 0.079 | 0.077 |
| % TBHP Remaining | — | — | — | — | 99 |

TABLE 1.5

| Elevated Temperature Stability At pH 8.0 | | | |
|---|---|---|---|
| Day | 0 | 9 | 28 |
| Composition 1A | | | |
| Amount $H_2O_2$ | 0.129 | 0.108 | 0.056 |
| % $H_2O_2$ Remaining | — | — | 43 |
| Composition 1B | | | |
| Amount TBHP | 0.080 | 0.080 | 0.075 |
| % TBHP Remaining | — | — | 94 |

TABLE 1.6

| Elevated Temperature Stability At pH 8.8 | | | |
|---|---|---|---|
| Day | 0 | 8 | 27 |
| Composition 1A | | | |
| Amount $H_2O_2$ | 0.128 | 0.098 | 0.056 |
| % $H_2O_2$ Remaining | — | — | 44 |
| Composition 1B | | | |
| Amount TBHP | 0.080 | 0.079 | 0.076 |
| % TBHP Remaining | — | — | 95 |

TABLE 1.7

| Elevated Temperature Stability At pH 9.5* | | | | | |
|---|---|---|---|---|---|
| Day | 0 | 5 | 12 | 19 | 29** |
| Composition 1A | | | | | |
| Amount $H_2O_2$ | 0.119 | 0.005 | — | <0.005 | <0.005 |

TABLE 1.7-continued

| Elevated Temperature Stability At pH 9.5* | | | | | |
|---|---|---|---|---|---|
| Day | 0 | 5 | 12 | 19 | 29** |
| % $H_2O_2$ Remaining | — | — | — | — | <5 |
| Composition 1B | | | | | |
| Amount TBHP | 0.078 | 0.079 | 0.079 | 0.077 | 0.076 |
| % TBHP Remaining | — | — | — | — | 97 |

TABLE 1.8

| Elevated Temperature Stability At pH 11.0 | | | | | |
|---|---|---|---|---|---|
| Day | 0 | 6 | 13 | 20 | 30 |
| Composition 1A | | | | | |
| Amount $H_2O_2$ | — | — | — | — | — |
| % $H_2O_2$ Remaining | — | — | — | — | — |
| Composition 1B | | | | | |
| Amount TBHP | 0.078 | 0.079 | 0.077 | 0.076 | 0.075 |
| % TBHP Remaining | — | — | — | — | 96 |

*The pH of Composition 1A was 9.6.
**This measurement for Composition 1A was taken on Day 28.

These stability studies demonstrate that hydrogen peroxide is unstable in the Base Formulation at pH 8, and that its instability increases with the pH and temperature of the Base Formulation. In contrast, TBHP is stable in the Base Formulation regardless of pH or temperature.

EXAMPLE 2

Stability Of Hydroperoxides In Alkaline Aqueous Cleaning Compositions 10 g of 70% t-butyl hydroperoxide (TBHP) or 10 g of 70% Luperox 2,5-2,5 were added to a solution of 990.0 g of an aqueous cleaning composition ("Base Formula 2"). Base Formula 2 is an aqueous cleaning composition that comprises the following raw materials per kg: 883.7 g deionized water, 40.0 g isopropanol, 25.0 g ethylene glycol n-butyl ether (Union Carbide Corporation), 11.3 g sodium lauryl sulfate (Stepanol WA-40 (40% actives in water) Stepan Chemicals), 5.0 g 1173 Silicone (General Electric Corporation), 10.0 g Surfynol 61 (Air Products Corporation), 15.0 g trisodium citrate (1.00M in water), and 10.0 g concentrated ammonia. The resulting solutions that are formed all have an initial pH of 10.5. The amount of peroxide remaining after a given time during which the composition was stored at a given temperature was used as a measure of the stability of peroxide in these compositions. The amount of peroxide was measured using standard iodometric procedures and is expressed in units of molarity (moles/liter of cleaning solution).

TABLE 2.1

| Base Formula 2 With 1% TBHP Solution | | | | |
|---|---|---|---|---|
| | Day 0 | Day 11 | Day 24 | % TBHP After 24 Days |
| Room Temperature | 0.075 | 0.074 | 0.073 | 97 |
| 100° F. | 0.075 | 0.074 | 0.072 | 96 |
| 125° F. | 0.075 | 0.073 | 0.070 | 93 |

TABLE 2.2

| Base Formula 2 With 1% Luperox 2,5-2,5 | | | | |
|---|---|---|---|---|
| | Day 0 | Day 23 | Day 33 | % Luperox After 33 Days |
| Room Temperature | 0.045 | 0.044 | 0.044 | 98 |
| 100° F. | 0.045 | 0.045 | 0.044 | 98 |

TABLE 2.2-continued

| Base Formula 2 With 1% Luperox 2,5-2,5 | | | | |
|---|---|---|---|---|
| | Day 0 | Day 23 | Day 33 | % Luperox After 33 Days |
| 125° F. | 0.045 | 0.043 | 0.038 | 84 |

These stability studies demonstrate that TBHP and Luperox 2,5-2,5 are stable in aqueous alkaline cleaning compositions.

EXAMPLE 3

Stain Cleaning Ability Of Aqueous Alkaline Cleaning Compositions

Carpet swatches measuring 4"×4" were stained by placing 2 ml of either grape juice, red wine, blueberry extract, or beef blood within a 1.5 inch diameter circular template centered on the carpet swatch. The stained swatches were allowed to dry for at least 24 hours at room temperature. The swatches were cleaned by applying 10×1 ml sprays of the composition indicated, wiping the spot with a paper towel or cheese cloth. This sequence was repeated one more time. The cleaned swatches were air dried overnight, lightly brushed and vacuumed.

Residual staining was measured in ΔE units on a Pacific Scientific Gardner Colorguard 45 Colorimeter. Larger ΔE values represent greater residual staining relative to a control swatch of an identical type of untreated carpeting. The values reported below are the average values of five treated carpet swatches.

Base Formula 2 was described previously. Base Formula 3 is an aqueous cleaning composition that comprises the following raw materials per kg: 873.5 g deionized water, 40.0 g isopropanol, 25.0 g propylene glycol t-butyl ether (Arcosolv PTB, Arco Chemical Company), 15.0 g sodium lauryl sulfate (Stepanol WA-30 (30% actives in water) Stepan Chemicals), 5.0 g 1173 Silicone (General Electric Corporation), 10.0 g Surfynol 61 (Air Products Corporation), 17.5 g trisodium citrate (1.00M in water), 3.50 g sodium silicate (sodium silicate "N" solution (PQ Corporation)), 10.0 g DuPont Zeelan 338 (25% actives in water), and fragrance. 70% TBHP or Luperox 2,5-2,5 is combined with the appropriate amount of Base Formula 2 or 3 to provide cleaning solutions with the concentrations of 70 % TBHP or Luperox 2,5-2,5 as indicated below.

TABLE 3.1

| Blueberry Extract Stain On Nylon Stainmaster Carpet | |
|---|---|
| Composition | ΔE |
| Base Formula 3 | 14.20 |
| Base Formula 3 With 0.125% TBHP | 9.46 |
| Base Formula 3 With 0.25% TBHP | 10.59 |
| Base Formula 3 With 0.50% TBHP | 10.27 |

TABLE 3.2

| Beef Blood Stain On Polyolefin Carpet | |
|---|---|
| Composition | ΔE |
| Base Formula 3 | 13.07 |
| Base Formula 3 With 0.063% Luperox | 7.49 |
| Base Formula 3 With 0.125% Luperox | 5.75 |

TABLE 3.2-continued

| Beef Blood Stain On Polyolefin Carpet | |
|---|---|
| Composition | ΔE |
| Base Formula 3 With 0.25% Luperox | 4.58 |

TABLE 3.3

| Beef Blood Stain On Polyolefin Carpet | |
|---|---|
| Composition | ΔE |
| Base Formula 2 | 11.59 |
| Base Formula 3 | 10.15 |
| Base Formula 2 With 0.25% Luperox | 4.19 |
| Base Formula 2 With 0.50% TBHP | 4.69 |

TABLE 3.4

| Beef Blood Stain On Nylon (Non-Stain Resistant) Carpet | |
|---|---|
| Composition | ΔE |
| Base Formula 2 | 10.93 |
| Base Formula 2 With 1% TBHP | 6.74 |
| Base Formula 2 With 2% TBHP | 6.38 |
| Base Formula 2 With 3% TBHP | 7.29 |

TABLE 3.5

| Red Wine Stain On Nylon (Non-Stain Resistant) Carpet | |
|---|---|
| Composition | ΔE |
| Base Formula 2 | 11.10 |
| Base Formula 2 With 1% TBHP | 7.88 |
| Base Formula 2 With 2% TBHP | 8.10 |
| Base Formula 2 With 3% TBHP | 8.17 |

TABLE 3.6

| Grape Juice Stain On Nylon (Non-Stain Resistant Carpet) | |
|---|---|
| Composition | ΔE |
| Base Formula 2 | 8.44 |
| Base Formula 2 With 3% TBHP | 5.80 |

These data demonstrate that the addition of TBHP or Luperox 2,5-2,5 enhances the stain removal ability of Base Formulations 2 and 3.

It will be apparent to those skilled in the art that the invention described herein can be practiced by other than the embodiments disclosed herein, which are presented for the purposes of illustration and not of limitation, and the present invention is limited only by the claims that follow.

I claim:

1. An aqueous alkaline soft-surface cleaning composition comprising:

a. an aqueous base composition comprising:

i. from about 2.5 to about 10 parts by weight of 3,5-dimethyl-1-hexyn-3-ol per 1000 parts of base composition;

ii. from about 4.52 to about 6.0 parts by weight of sodium lauryl sulfate per 1000 parts of base composition; and b. a tertiary alkyl hydroperoxide added to said base to form a composition containing from about 0.1 to about 5.0 by weight of the hydroperoxide relative to the weight of the total composition.

2. The composition of claim 1 therefor the tertiary alkyl hydroperoxide is selected from the group consisting of t-butyl hydroperoxide and 2,5-dimethylhexane-2,5-dihydroperoxide.

* * * * *

UNITED STATES PATENT AND TRADEMARK OFFICE

CERTIFICATE OF CORRECTION

PATENT NO. : 5,284,597

DATED : February 8, 1994

INVENTOR(S) : Wayne M. Rees

It is certified that error appears in the above-identified patent and that said Letters Patent is hereby corrected as shown below:

In column 6, line 61, insert —parts— after "5.0".

Signed and Sealed this

Twenty-first Day of February, 1995

*Attest:*

*Attesting Officer*

BRUCE LEHMAN

*Commissioner of Patents and Trademarks*